US009085181B2

(12) United States Patent
Komuro

(10) Patent No.: US 9,085,181 B2
(45) Date of Patent: Jul. 21, 2015

(54) PRINTING APPARATUS

(75) Inventor: Shintaro Komuro, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 1329 days.

(21) Appl. No.: 12/869,419

(22) Filed: Aug. 26, 2010

(65) Prior Publication Data

US 2011/0050783 A1 Mar. 3, 2011

(30) Foreign Application Priority Data

Aug. 27, 2009 (JP) ..... 2009-196444

(51) Int. Cl.
*B41J 2/015* (2006.01)
*B41J 19/20* (2006.01)

(52) U.S. Cl.
CPC ..... *B41J 19/205* (2013.01)

(58) Field of Classification Search
CPC ..... B41J 19/205; B41J 2/1623; B41J 2/1631; B41J 2/1628; B41J 2/14024; B41J 2/1603
USPC ..... 347/5–20
See application file for complete search history.

(56) References Cited

U.S. PATENT DOCUMENTS

| | | | | |
|---|---|---|---|---|
| 6,254,292 | B1 | 7/2001 | Navarro | |
| 6,834,925 | B2 | 12/2004 | Ikeda | |
| 2003/0016266 | A1* | 1/2003 | Urselmann | 347/37 |
| 2004/0135865 | A1* | 7/2004 | Nunokawa | 347/104 |
| 2006/0170720 | A1* | 8/2006 | Akase et al. | 347/14 |
| 2007/0097166 | A1* | 5/2007 | Nakata et al. | 347/19 |
| 2007/0109338 | A1* | 5/2007 | Niioka | 347/16 |
| 2007/0139462 | A1* | 6/2007 | Tamaki | 347/20 |
| 2007/0146408 | A1* | 6/2007 | Tamaki et al. | 347/19 |
| 2007/0229573 | A1* | 10/2007 | Takeishi et al. | 347/19 |
| 2008/0036814 | A1* | 2/2008 | Takeishi et al. | 347/19 |
| 2008/0068632 | A1* | 3/2008 | Fukasawa | 358/1.12 |
| 2009/0057981 | A1* | 3/2009 | Fukasawa et al. | 271/3.09 |

FOREIGN PATENT DOCUMENTS

| | | |
|---|---|---|
| JP | 09-277643 | 10/1997 |
| JP | 10-226122 | 8/1998 |
| JP | 11-078147 | 3/1999 |
| JP | 2000-238360 | 9/2000 |
| JP | 2000-296650 | 10/2000 |
| JP | 2002-096528 | 4/2002 |
| JP | 2002-205435 | 7/2002 |
| JP | 2004-160871 | 6/2004 |
| JP | 2005-081826 | 3/2005 |
| JP | 2005-169967 | 6/2005 |
| JP | 2006-142701 | 6/2006 |
| JP | 2007-45006 | 2/2007 |

* cited by examiner

*Primary Examiner* — Manish S Shah
*Assistant Examiner* — Yaovi Ameh
(74) *Attorney, Agent, or Firm* — Workman Nydegger

(57) ABSTRACT

A printing apparatus includes: a carriage mounting print head, executing scanning in a direction perpendicular to a transport direction of a printing medium, and being movable in a vertical direction in accordance with the thickness of the printing medium; an encoder scale having a predetermined pattern and extending in the direction perpendicular to the transport direction; a detection sensor detecting the pattern of the encoder scale and including a slit into which the encoder scale is inserted; and a frame shaft-supporting a transport roller transporting the printing medium. The encoder scale stretches in the frame and a predetermined portion of the encoder scale in the extension direction engages with the frame through an engagement section.

4 Claims, 9 Drawing Sheets

PRINTING APPARATUS

BACKGROUND

1. Technical Field

The present invention relates to a printing apparatus including a multi-function apparatus of a printer, a facsimile, and a copier executing printing on a printing medium.

2. Related Art

As an ink jet printer, there is known a serial type printer that reciprocates a carriage mounting a print head in a width direction intersecting a transport direction of a printing medium such as a printing sheet.

A serial type printer has a configuration in which the movement distance and the speed of the carriage is detected by allowing a detection sensor disposed in the carriage to read an encoder scale fixed to a printer main body and the print head is operated in synchronization with the detection result to obtain a high-quality image without dot position misalignment.

However, when sheet jamming or the like occurs during the operation of the printer, a user needs to take out the jammed sheet from the printer in person. At this time, when the hand of the user or the sheet comes into contact with the encoder scale, the scale position is changed. Therefore, a problem may arise in that the encoder scale may be deviated from an encoder slit of the detection sensor. When the encoder scale is deviated from the encoder slit, the movement motion of the carriage is not controlled, thereby causing breakdown.

In order to solve this problem, JP-A-9-277643 discloses the configuration in which a guide member engages so as to be pinched between both sides of the encoder scale in order to correct the relative position of the encoder scale relative to the detection sensor.

In recent years, printers have been used which are able to print an image on various kinds of printing media, such as a CR-R or a heavy sheet, different in size or thickness. When printing is executed on these printing media, the carriage is moved in a vertical direction so that the gap between the carriage and a platen is varied depending on the thickness of the printing media. In this case, since a lower portion of the encoder slit is opened and the encoder scale is fixed to a frame of the printer main body, the encoder scale may come out from the encoder slit more easily as the movement amount of the carriage is larger. That is, when a thick printing medium is used, the encoder scale may easily come out due to the increase in the movement amount of the carriage.

A configuration preventing the encoder scale from coming out may be taken into consideration by forming the encoder slit with a bag-like shape. However, in this configuration, it is necessary to ensure a slit space in the lower portion of the encoder scale to the degree that the slit space does not interrupt the encoder scale during the vertical movement motion of the carriage. However, since a transport roller holder that shaft-supports a transport roller transporting the printing medium is disposed in the lower portion of the encoder scale, it is difficult to ensure the slit space in the lower portion of the encoder scale.

SUMMARY

An advantage of some aspects of the invention is that it provides a printing apparatus preventing an encoder scale from being deviated from an encoder slit formed in a carriage.

According to an aspect of the invention, there is provided a printing apparatus including: a carriage mounting print head, executing scanning in a direction perpendicular to a transport direction of a printing medium, and being movable in a vertical direction in accordance with the thickness of the printing medium; an encoder scale having a predetermined pattern and extending in the direction perpendicular to the transport direction; a detection sensor detecting the pattern of the encoder scale and including a slit into which the encoder scale is inserted; and a frame shaft-supporting a transport roller transporting the printing medium. The encoder scale stretches in the frame and a predetermined portion of the encoder scale in the extension direction engages with the frame through an engagement section.

In the printing apparatus according to the aspect of the invention, since the frame and the encoder scale are engaged by the engagement section, movement of the encoder scale in the transport direction of the printing medium and an opposite direction to the transport direction can be regulated. Accordingly, the encoder scale can be prevented from being deviated from the encoder slit.

The engagement section may include an engagement hole portion formed in the encoder scale and an engagement portion disposed in the frame and engaging with the engagement hole portion.

In the printing apparatus according to the aspect of the invention, the engagement section includes the engagement hole portion formed in the encoder scale and the engagement portion disposed in the frame and engaging with the engagement hole portion. Therefore, the movement of the encoder scale in the transport direction of the printing medium and an opposite direction to the transport direction can be regulated. Moreover, the vertical bending of the encoder scale in the extension direction can be prevented. Accordingly, the encoder scale can be prevented from being deviated from the encoder slit of the detection sensor.

One end of the encoder scale may be directly fixed to one wall of the frame, which faces the one end of the encoder scale in a direction perpendicular to the transport direction, and the other end of the encoder scale may be fixed to the other wall through an elastic member. The encoder scale may stretch by an urging force of the elastic member.

In the printing apparatus according to the aspect of the invention, since the encoder scale is pulled in the extension direction by the urging force of the elastic member, the bending of the encoder scale is prevented and thus the engagement of the engagement hole portion and the engagement portion can be maintained satisfactorily. Moreover, the movement of the encoder scale itself can be prevented.

A front end of the engagement portion may extend in the extension direction of the encoder scale and may be formed as a hook member formed so as to be bent toward the elastic member.

In the printing apparatus according to the aspect of the invention, the front end of the engagement portion extends in the extension direction of the encoder scale and the engagement portion is formed from the hook member bent toward the elastic member. Therefore, the engagement portion scarcely comes out from the engagement hole portion. Accordingly, the engagement of the engagement hole portion and the engagement portion can be maintained satisfactorily.

A plurality of the engagement sections may be formed in the extension direction of the encoder scale.

In the printing apparatus according to the aspect of the invention, the plurality of engagement sections are formed in the extension direction of the encoder scale. Therefore, the bending or the movement of the encoder scale can be further regulated. Accordingly, the encoder scale can be more reliably prevented from being deviated from the encoder slit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
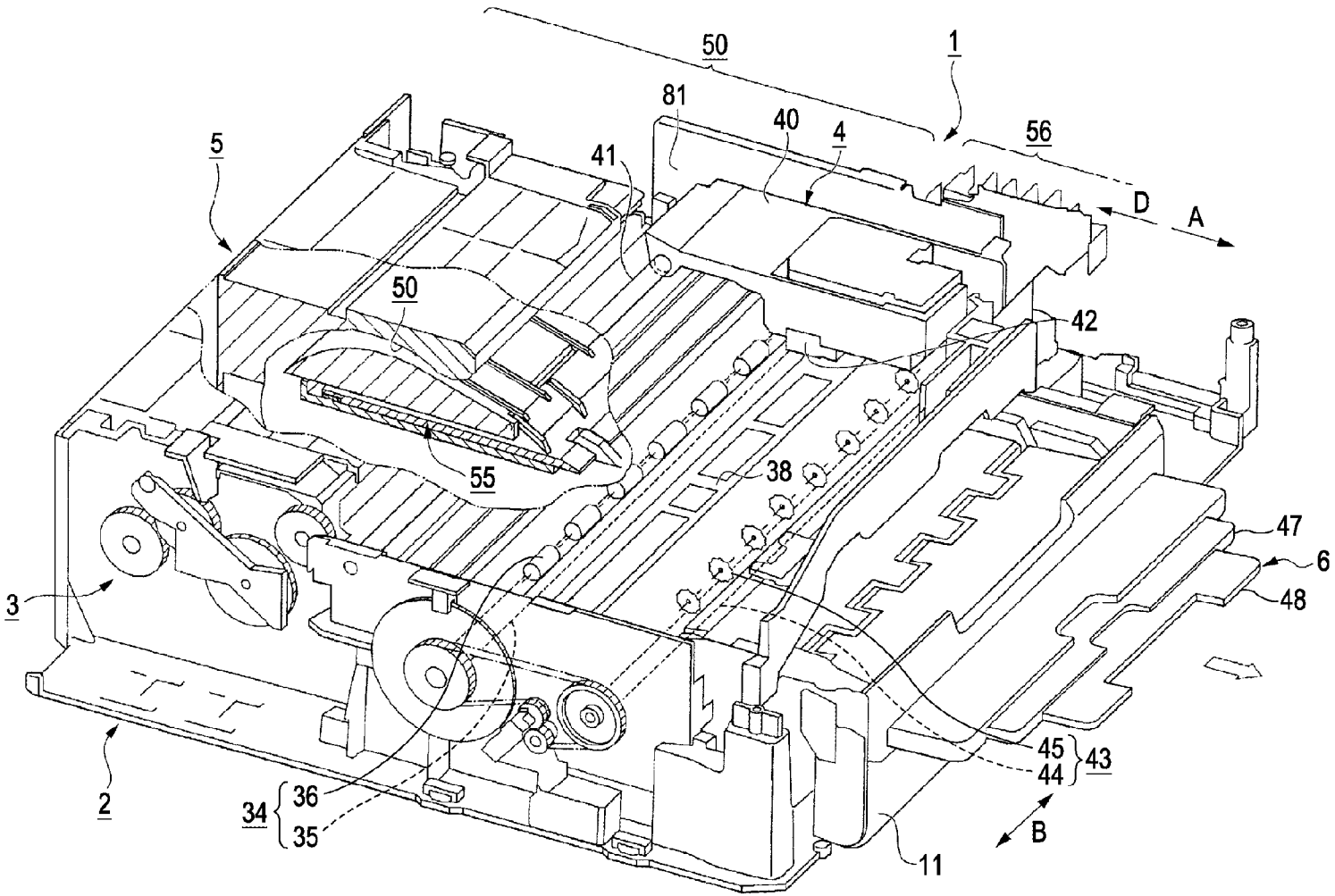
FIG. 1 is a perspective view illustrating the internal configuration of an ink jet printer according to an embodiment.

Hereinafter, an embodiment of the invention will be described with reference to the drawings. In the drawings referred in the following description, the scale of each unit is appropriately adjusted to easily recognize the size of each unit.

Figure 2:
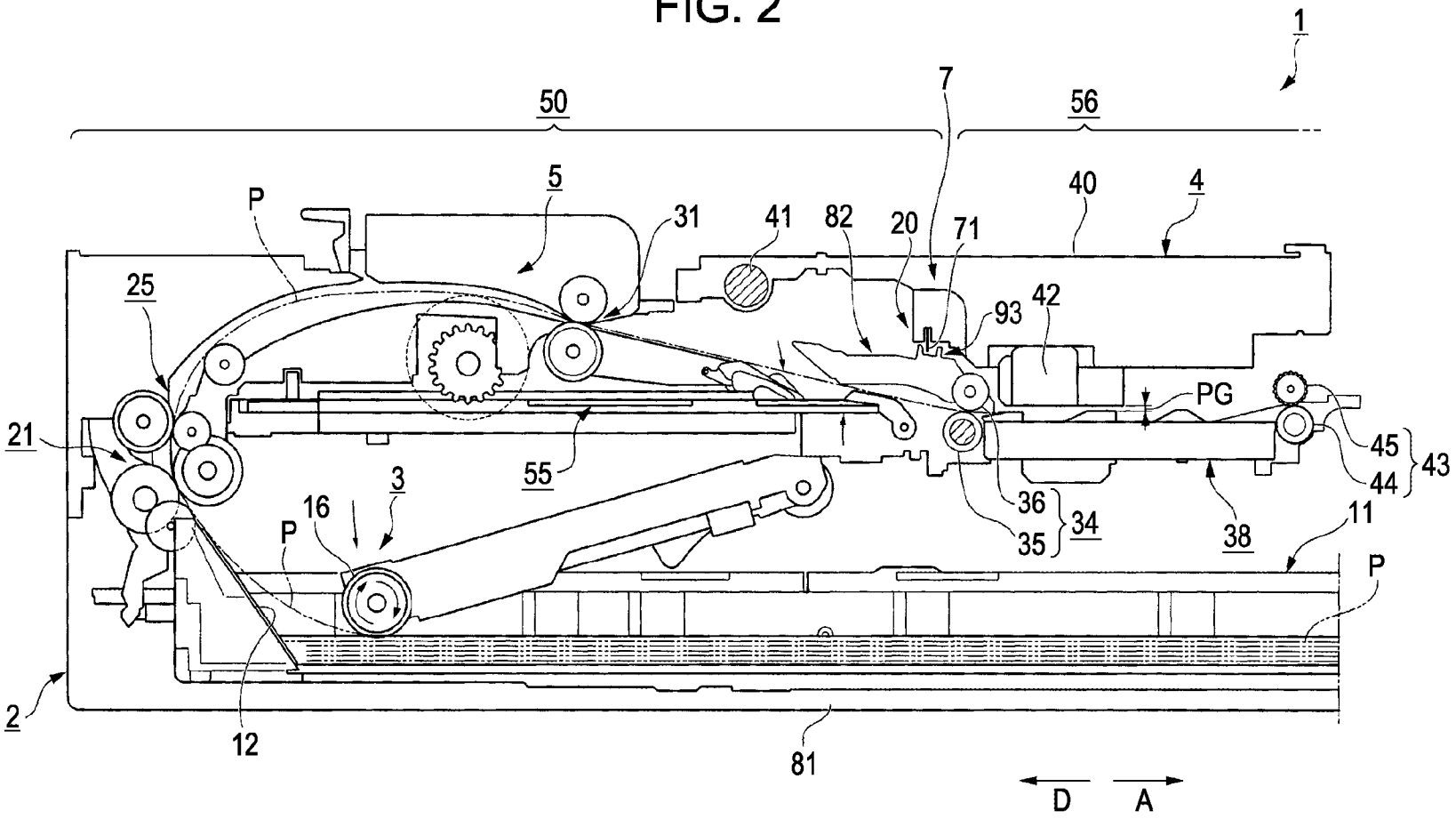
FIG. 2 is a sectional view illustrating the internal configuration of the ink jet printer.
Figure 3:
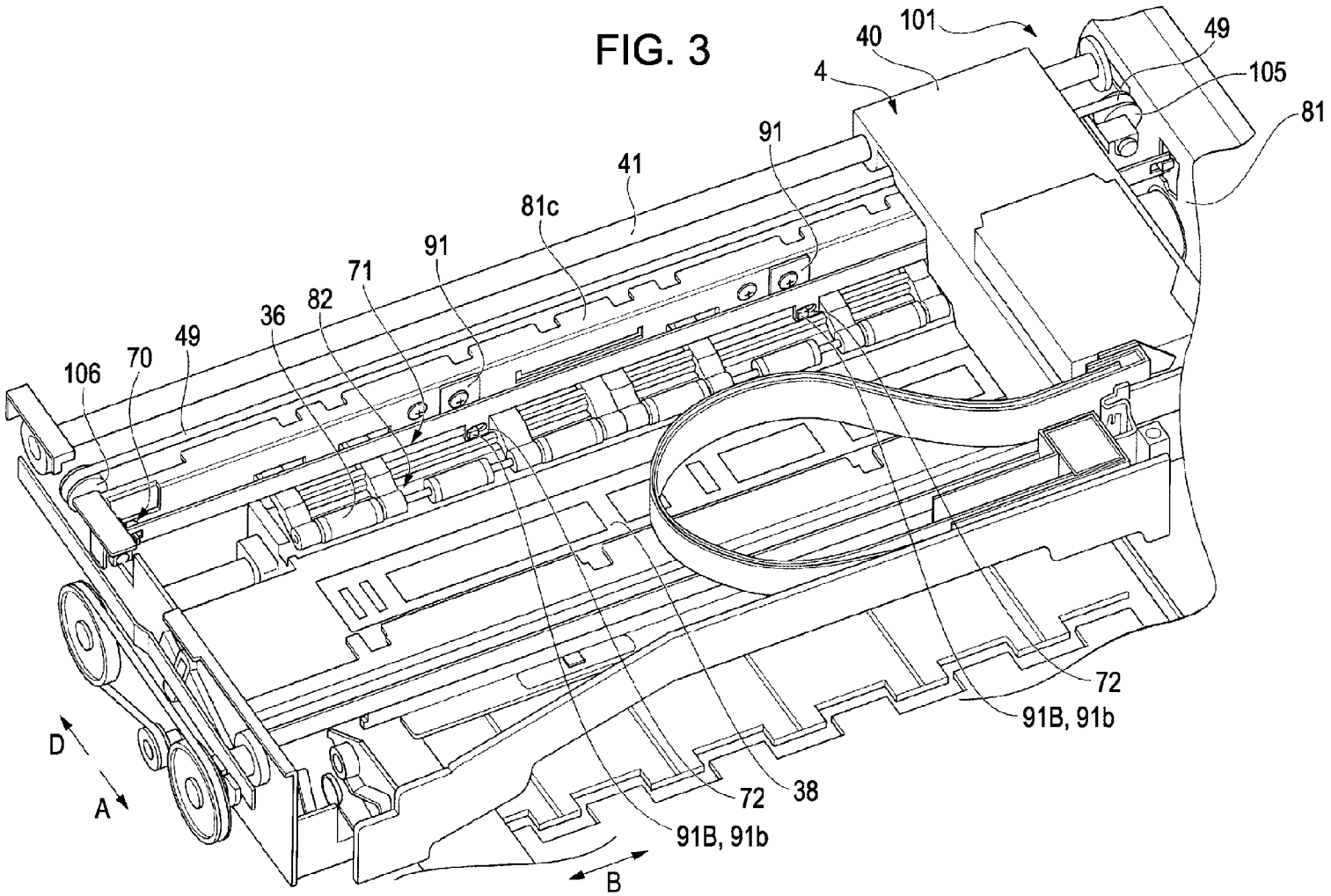
FIG. 3 is a perspective view illustrating the configuration of an encoder device and the periphery of the encoder device.
Figure 4:
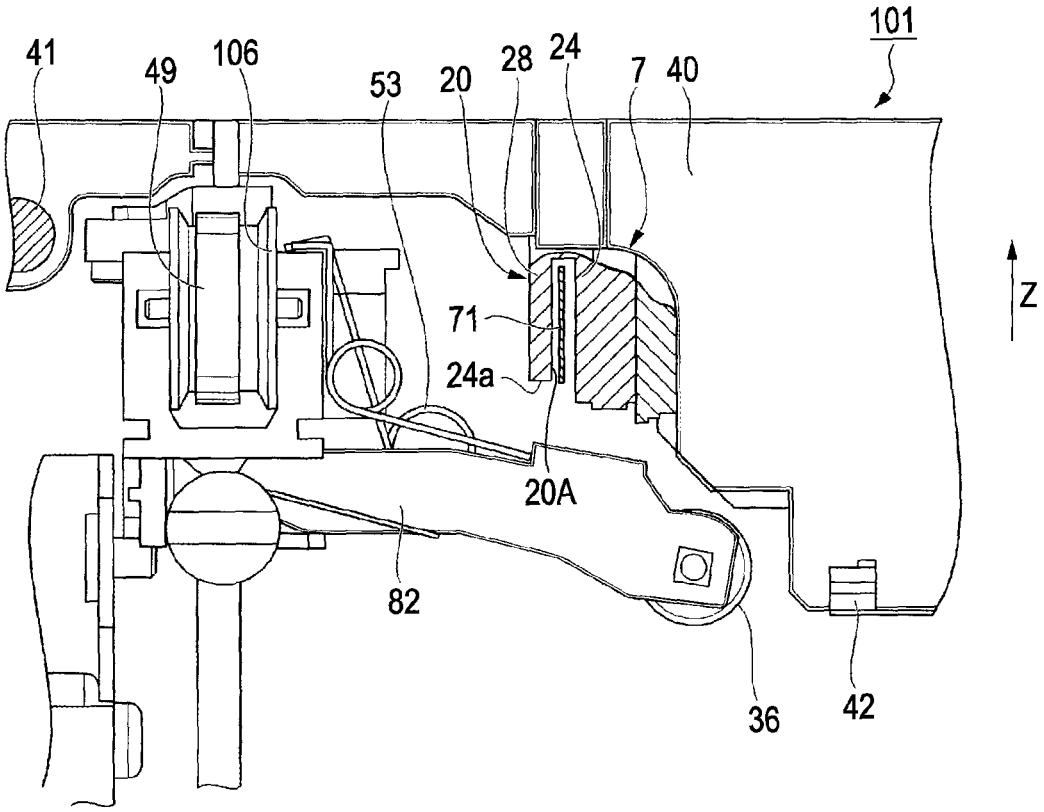
FIG. 4 is a side view illustrating the configuration of the encoder device and the periphery of the encoder device.

FIG. 1 is a perspective view illustrating the internal configuration of an ink jet printer as a printing apparatus according to an embodiment of the invention. FIG. 2 is a sectional view illustrating the internal configuration of the ink jet printer. FIG. 3 is a perspective view illustrating the configuration of an encoder device and the periphery of the encoder device. FIG. 4 is a side view illustrating the configuration of the encoder device and the periphery of the encoder device. In FIG. 4, the cross-sections of an encoder scale and a detection sensor are illustrated.

The ink jet printer 1 according to this embodiment is a serial printer in which a print head 42 is mounted on the bottom surface of a carriage 40 that is able to reciprocate in a width direction B intersecting a transport direction A in a print execution area 56, as shown in FIGS. 1 to 4. In the following description, a downstream side and an upstream side in a transport direction of a printing medium P are based on a movement direction of the printing medium P.

As shown in FIGS. 1 and 2, the ink jet printer 1 includes a printer main body 2, a feeding device 3 feeding the printing medium P, a print execution device 4 executing printing on the printing medium P, a transport device 5 transporting the printing medium P in the transport direction, an encoder device 7, a discharge device 6 discharging the printing medium P, and a control device (not shown) controlling the constituent units of the printer.

The feeding device 3 includes a pickup roller 16 continuously sending out the uppermost medium among the printing media P received in a feeding cassette 11, a separation inclined surface 12 separating the continuously sent-out uppermost medium and guiding the uppermost medium to a U-shaped turnover path 50, a separation roller 21 completely separating the subsequent printing medium P not separated on the separation inclined surface 12 from the uppermost printing medium P, and intermediate transport rollers 25 and 31 transporting the printing medium P along the U-shaped turnover path 50.

As shown in FIGS. 1 to 4, the transport device 5 includes a unit frame (frame) 81, transport rollers 34, a transport driven roller holder 82, and a tray 55. The transport rollers 34 includes nip rollers, that is, a transport driving roller 35 (transport roller) and transport driven rollers 36. The transport driving roller 35, the transport driven roller holder 82, and the tray 55 are mounted on the unit frame 81. A platen 38 supporting the transport position of the printing medium P is installed in the unit frame 81.

The plurality of transport driven rollers 36 are shaft-supported to the transport driven roller holder 82 and are typically urged toward the transport driving roller 35 to the downward position by the transport driven roller holder 82 (see FIG. 2). A plurality of urging springs 53 is connected to the transport driven holder 82, and thus the transport driven rollers 36 are typically urged toward the transport driving roller 35 by the elastic force of the urging springs 53. The transport driven roller holder 82 is vertically moved in a Z direction in accordance with the thickness of the printing medium P (see FIG. 4). However, since the carriage 40 is also configured to be vertically moved in this manner, the transport driven roller holder 82 does not come into contact with the carriage 40.

As shown in FIGS. 3 and 4, the print execution device 4 includes the print head 42 executing printing on the printing medium P and a carriage unit 101 mounting the print head 42.

The print head 42 is mounted on the bottom surface of the carriage 40 retaining an ink cartridge. The print head 42 is disposed to vertically face the platen 38 disposed on the downstream side of the transport rollers 34 (see FIG. 2). The print head 42 executes predetermined printing on the printing medium P supplied on the platen 38 by the transport rollers 34.

The carriage unit 101 includes the carriage 40, a carriage guide shaft 41, a driving pulley 105, a driven pulley 106, a carriage motor (not shown), and a printing medium detector (not shown).

The driving pulley 105 is mounted on the carriage motor. A carriage belt 49 is suspended between the driving pulley 105 and the driven pulley 106. The carriage 40 mounting the print head 42 is fixed to the carriage belt 49. When the driving pulley 105 and the carriage belt 49 are rotated by the driving of the carriage motor, the carriage 40 fixed to the carriage belt 49 is configured to reciprocate in a main scanning direction along the carriage guide shaft 41.

The carriage 40 is vertically moved on the carriage guide shaft 41 in the Z direction relative to the platen 38 (the printing medium P) so that the gap (platen gap PG: see FIG. 2) between the platen 38 and the print head 42 is varied in accordance with the thickness of the printing medium P. The vertical movement of the carriage 40 is realized by a platen gap varying mechanism (not shown). Therefore, the platen gap PG can be varied in accordance with the printing on a CD-R, a heavy sheet, or the like. In this embodiment, the carriage 40 can be moved by about the maximum 4.6 mm in the Z direction.

The encoder device 7 is a device that detects the position of the carriage 40 in the scanning direction. The encoder device 7 includes an encoder scale 71 with a predetermined pattern and a detection sensor 20 optically detecting the pattern of the encoder scale 71.

In the encoder scale 71, the predetermined pattern, in which light-shielding portions and light-transmitting portions are alternately formed in the extension direction, is formed. The encoder scale 71 extends in the width direction B perpendicular to the transport direction A of the printing medium P and stretches in the above-described unit frame 81. In this embodiment, as shown in FIG. 3, one end of the encoder scale 71 is directly fixed to the unit frame 81 and the other end of the encoder scale 71 is mounted on the unit frame 81 with an elastic member 70, which prevents bending in the extension direction, interposed therebetween.

As shown in FIG. 4, the detection sensor 20 is integrally installed on the rear surface of the carriage 40. The detection sensor 20 follows the carriage 40 to read the predetermined pattern formed in the encoder scale 71 and detect the movement distance of the carriage 40 in the scanning direction.

The detection sensor 20 includes a light-emitting portion 24 emitting light toward the encoder scale 71 and a light-receiving portion 28 receiving the emitted light of the light-emitting portion 24. The detection sensor 20 is connected to a circuit board (not shown). The light-emitting portion 24 and the light-receiving portion 28 are disposed to face each other at a constant interval in the thickness direction of the encoder scale 71. Therefore, the encoder scale 71 is inserted into an encoder slit 20A between the light-emitting portion 24 and the light-receiving portion 28.

In this embodiment, the optical sensor is used, but a magnetic sensor may be used.

The print execution device 4 includes an ink tube with a plurality of lines and an ink supply pump (all of which are not shown) supplying ink of respective colors to the print head 42 and a capping device (not shown) disposed in a home position of the carriage 40.

As shown in FIG. 2, the discharge device 6 includes a discharge roller 43 and a discharge stacker 47.

The discharge rollers 43 includes nip rollers, that is, a discharge driving roller 44 and discharge driven rollers 45. The printing medium P transported by the operation of the above-described transport rollers 34 is supplied to a nip point of the discharge rollers 43 via the platen 38. The discharge driving roller 44 is connected to the same driving motor as that of the above-described transport driving roller 35, and thus operates in interlock with the driving roller 35.

The discharge stacker 47 is a unit which stacks the printing media P subjected to the printing in an overlapping manner and is disposed above the mount surface of the feeding cassette 11. In the discharge stacker 47, an extension stacker 48 received in an inserted form therein and is installed so as to be extracted or accommodated.

In the ink jet printer 1, the printing medium P supplied to the U-shaped turnover path 50 by the above-described roller 16 is transmitted to the separation roller 21 and the intermediate transport rollers 25 and 31, and is supplied to the nip point of the transport roller 34 disposed near the downstream side of the U-shaped turnover path 50 via the U-shaped turnover path 50 by a guiding operation. The platen 38 and the print head 42 face each other in a vertical direction on the downstream side of the transport roller 34. Therefore, when the printing medium P is supplied on the platen 38 by the rotation of the transport driving roller 35 and is transported to the position facing the print head 42, the printing head 42 executes the printing. The printing medium P subjected to the printing is sent to the discharge stacker 47 by the discharge roller 43.

Next, the configuration of the encoder device 7 and the periphery thereof will be described according to this embodiment.

Figure 5:
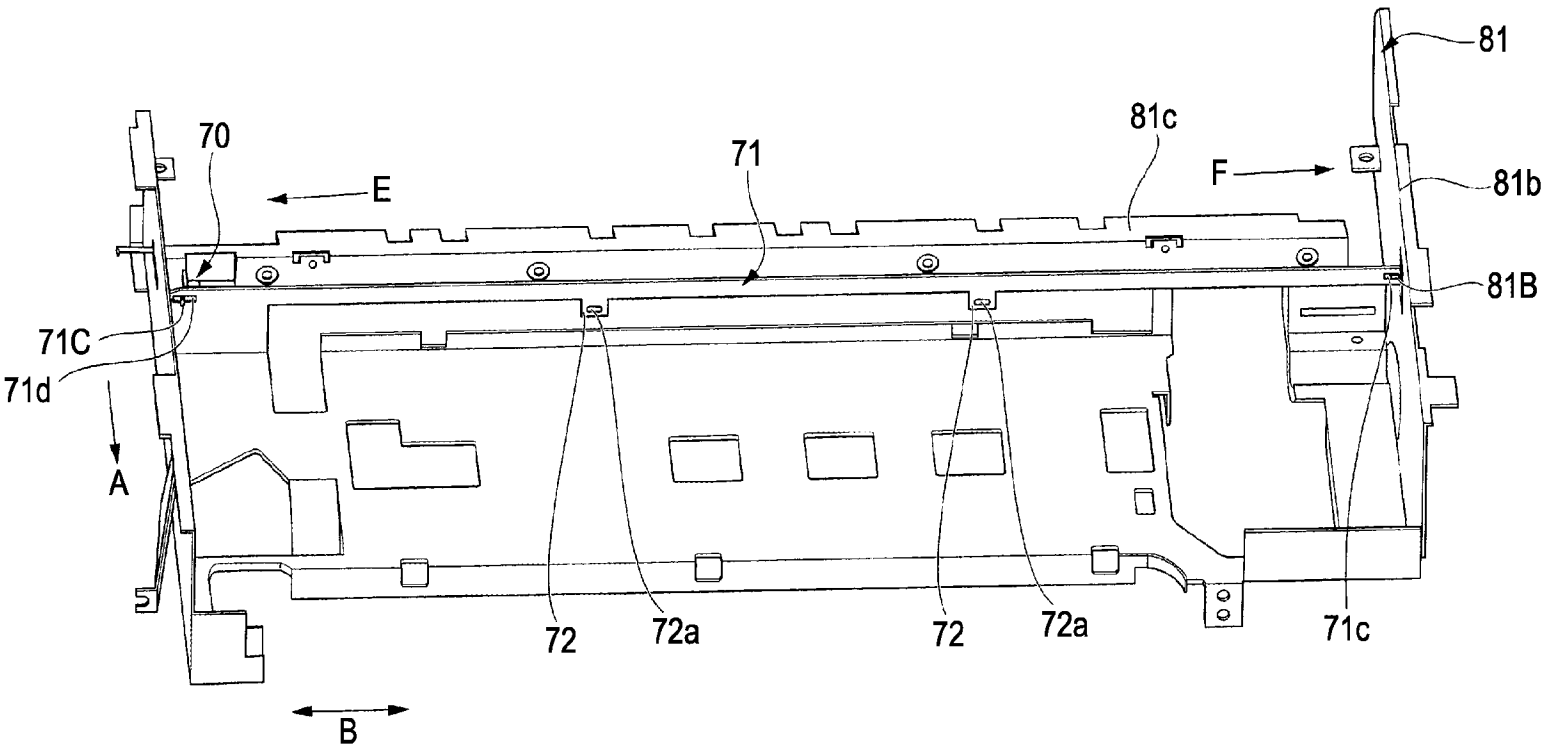
FIG. 5 is a perspective view illustrating the entire configuration of a frame unit mounted with an encoder scale.
Figure 6A:
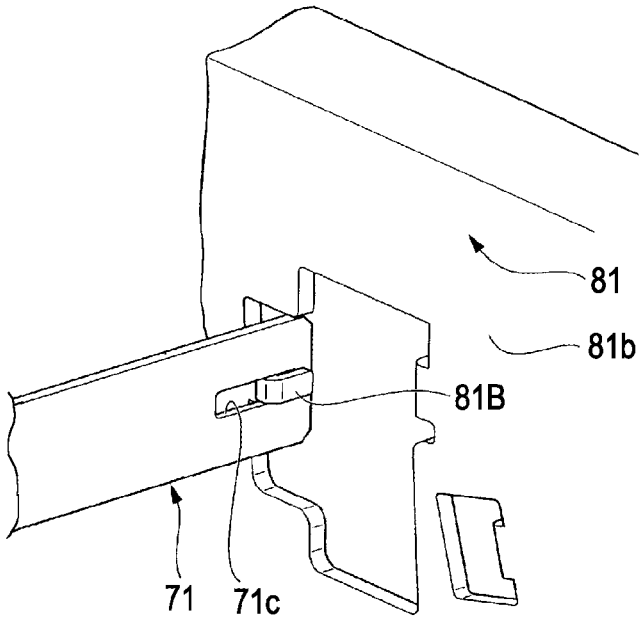
FIGS. 6A and 6B are enlarged partially sectional views illustrating the major elements of the encoder device.
Figure 6B:
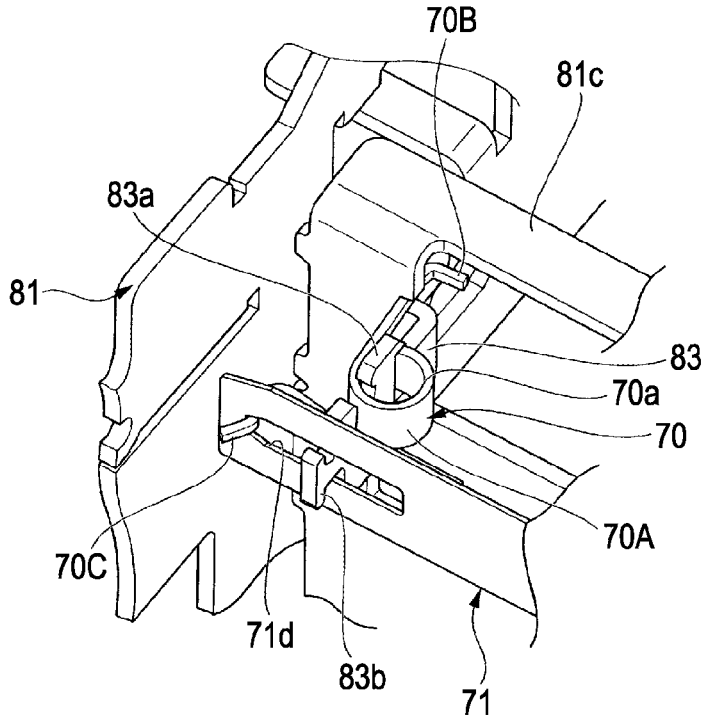
Figure 7:
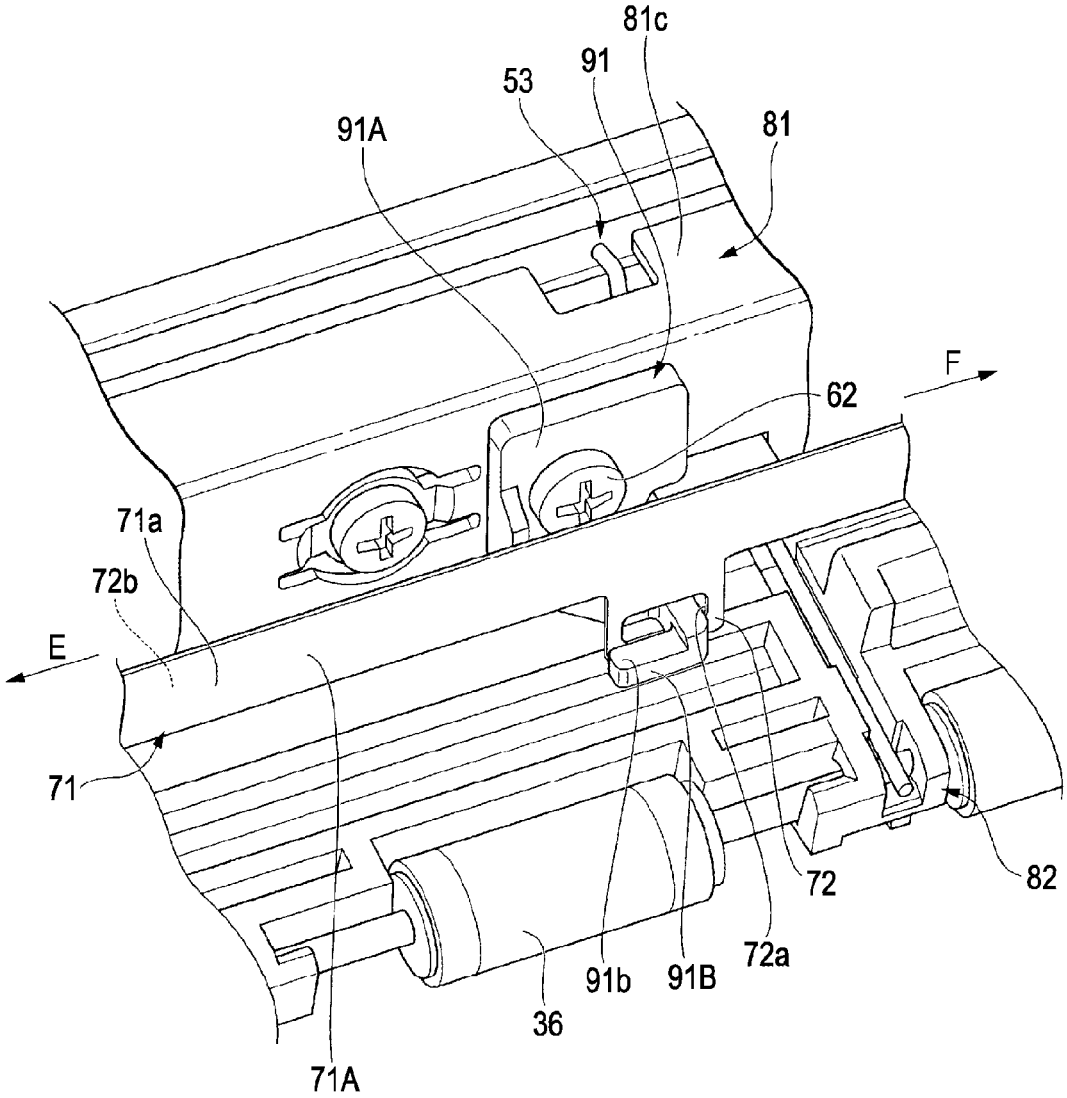
FIG. 7 is a sectional view illustrating a positional relation between the encoder scale, a detection unit, and a regulation unit at a reference position.

FIG. 5 is a perspective view illustrating the entire configuration of the frame unit mounted with the encoder scale. FIGS. 6A and 6B are enlarged diagrams illustrating the major elements of the elastic member. FIG. 7 is a perspective view illustrating the configuration of an engagement portion of the encoder scale.

In the following description, the relation and the configuration of the members will be described when the carriage 40 and the transport driven roller holder 82 is located at a reference position. Here, the reference position of the carriage 40 and the transport driven roller holder 82 refers to a position at which the platen gap PG is smallest.

As shown in FIG. 5, the encoder scale 71 stretches in the above-described unit frame 81 so as extend in the width direction B perpendicular to the transport direction A of the printing medium P. As shown in FIGS. 5 and 6A, the encoder scale 71 is fixed in a state where a hook hole 71*c* formed in one end in the extension direction is hooked to a hook portion 81B formed in a side wall 81*b* of the unit frame 81. As shown in FIGS. 5 and 6B, the other end of the encoder scale 71 is fixed to a wall 81*c* of the unit frame 81 through the elastic member 70, such as an elastic spring, with an elastic force.

Here, the elastic member 70 has a configuration in which a center portion 70A is formed in a ring shape and both end portions 70B and 70C are formed long to the outside. An attachment portion 83 bent toward the transport direction is formed on a wall 81*c* of the unit frame 81. The elastic member 70 is mounted on the attachment portion 83.

Specifically, the elastic member 70 is mounted in a state where a convex portion 83*a* of the attachment portion 83 is mounted to be inserted in a circular hole 70*a* of the center portion 70A, the one end portion 70B is locked in the base portion of the attachment portion 83, and the other end portion 70C is locked in a hook hole 71*d* of the encoder scale 71. With such a configuration, one end of the encoder scale 71 is typically urged in the extension direction. The hook hole 71*d* has a rectangular shape with a length in the extension direction. A front end 83*b* of the attachment portion 83 is inserted into the middle of the hook hole 71*d*.

The encoder scale 71 according to this embodiment is pulled toward the outside (direction indicated by an arrow C) in the extension direction by the elastic force of the elastic member 70. When the encoder scale 71 is pulled in an opposite direction of the arrow C by the force against the elastic force, the encoder scale 71 can be moved by a distance corresponding to the gap of the hook hole 72*c*.

That is, in order to mount the encoder scale 71 on the unit frame 81, the hook hole 71*d* on one end side in the extension direction first is hooked in the end portion 70*c* of the elastic member 70 and then the hook hole 71*c* is mounted in the hook portion 81B while pulling the other side by a force against the elastic force of the elastic member 70 in a direction, which is indicated by an arrow F, opposite to the direction, which is indicated by an arrow E. In this way, the encoder scale 71 is typically in pulled state in the extension direction by the elastic force of the elastic member 70. Therefore, the encoder scale 71 stretches in the unit frame 81 without being bent.

Since the encoder scale 71 is made of a thin plastic film with low rigidity, the middle portion of the encoder scale 71 in the extension direction is easily bent in a vertical direction and its thickness direction. However, as described above, the encoder scale 71 with the above-described configuration according to the embodiment is prevented from being curved with time.

In the encoder scale 71, as shown in FIGS. 5 and 7, a plurality of engagement hole portions (engagement section) 72 protruding toward the transport driven roller holder 82, which is located below the lower end portion of a scale main body 71A, is formed in predetermined portions in the extension direction. The plurality of engagement hole portions 72 is disposed at a predetermined interval in the extension direction of the encoder scale 71. In this embodiment, two engagement hole portions 72 are disposed at the same positions from both ends. A hole 72*a* formed in the middle of each engagement hole portion 72 is formed in a rectangular shape or an oval shape. The major axis thereof is formed in the extension direction of the encoder scale 71. An engagement portion (engagement section) 91 formed in the unit frame 81 engages with the hole 72*a* of each engagement hole portion 72.

The plurality of engagement portions 91 is fixed to the unit frame 81. Specifically, the plurality of engagement portions 91 is formed on the wall 81*c* of the unit frame 81 extending in the extension direction of the encoder scale 71 and located on the side of a rear surface 71*b* of the encoder scale 71. The engagement portions 91 are disposed at the positions corresponding to the engagement hole portions 72 of the encoder scale 71. The engagement portion 91 serves as a hook member that includes a fixation portion 91A screw-fixed to the wall 81C and an engagement claw 91B engaging with the hole 72*a* of the above-described engagement hole portion 72. In this embodiment, each of the two engagement portions 91 is mounted at the position facing the engagement hole portion 72 through a screw 62.

The engagement claw 91B is erected so as to be substantially perpendicular toward the encoder scale 71 from the surface of the fixation portion 91A, and a front end of the engagement claw 91B extends in the extension direction of the encoder scale 71 and has an L shape bent toward the elastic member 70. A bent front end 91*b* of the engagement claw 91B is inserted into the hole 72*a* of the engagement hole portion 72 and projects toward the surface 71*a* of the encoder scale 71. Therefore, the engagement claw 91B is configured to engage in the hole 72*a* of the engagement hole portion 72.

The engagement claw 91B is inserted into the hole 72*a* of the engagement hole portion 72. However, the engagement claw 91B is configured so as not to come into contact with the engagement hole portion 72. Since the length (a length in the extension direction of the encoder scale 71) of the front end 91*b* of the engagement claw 91B is set to be equal or larger than that of the major axis of the above hole 72*a*, the engagement portion 91 is configured so as not to be deviated from the hole 72*a* due to the movement of the encoder scale 71 in the transport direction A of the printing medium P or an opposite direction D to the transport direction A.

Figure 9A:
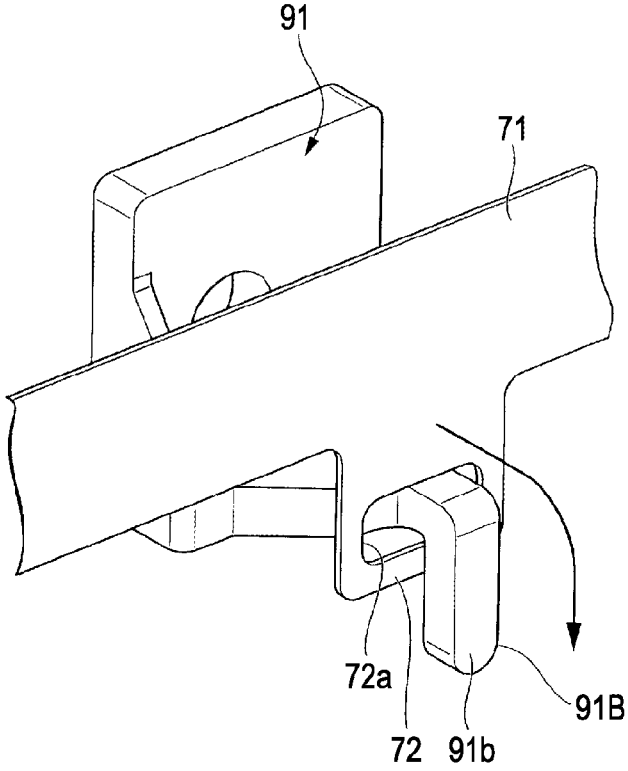
FIGS. 9A and 9B are sectional views illustrating a positional relation of an encoder scale, a detection unit, and a regulation unit according to a known example.
Figure 9B:
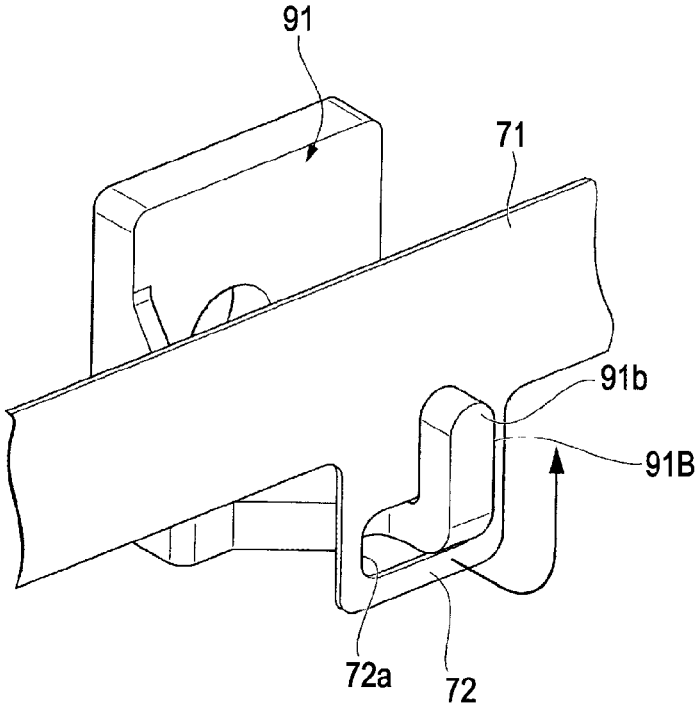

As described above, the front end 91*b* of the engagement claw 91B according to this embodiment extends in the extension direction of the encoder scale 71 and is bent toward the elastic member 70. When the front end 91*b* of the engagement claw 91B is bent toward the upper side or the lower side, as shown in FIGS. 9A and 9B, the movement of the encoder scale 71 in the extension direction can be regulated, but the movement of the encoder scale 71 in the transport direction is insufficiently regulated. That is, the engagement hole portion 72 may be easily deviated from the engagement claw 91B in a direction indicated by the arrows in the drawings, depending on the length of the front end 91*b*.

According to this embodiment, in order to resolve this circumstance, the front end 91*b* of the engagement claw 91B is configured to extend in the extension direction of the encoder scale 71, as shown in FIG. 7. Therefore, an advantage can be efficiently obtained that the bending of the encoder scale 71 is regulated in the vertical direction or the thickness direction.

With such a configuration, even when the encoder scale 71 is pulled in a direction (see FIG. 7) indicated by an arrow F by the force against the elastic force of the elastic member 70, the degree that the engagement hole portion 72 and the engagement portion 91 (the engagement claw 91B) are connected to each other becomes larger. Thus, the encoder scale 71 is rarely deviated.

In this embodiment, as described above, the detection sensor 20 is mounted on the carriage 40. Therefore, the detection sensor 20 follows the movement of the carriage 40 in the scanning direction and the Z direction. However, since the encoder scale 71 is mounted and fixed to the unit frame 81, the overlapping amount with the detection sensor 20 is varied.

In the configuration having no engagement hole portion 72 or no engagement portion 91 according to a known example, the overlapping amount of the encoder scale 71 with the detection sensor 20 may be small due to occurrence of stroke in the Z direction of the carriage 40. For this reason, a problem may arise in that the encoder scale 71 is easily inserted into or detached from the encoder slit 20A of the detection sensor 20. For example, when a sheet is jammed during printing and a user removes the jammed sheet, the user may erroneously touch the encoder scale 71 from the outside and thus the encoder sale 71 may be deviated from the encoder slit 20A of the detection sensor 20.

In this embodiment, however, the movement of the encoder scale 71 is regulated in such a manner that the engagement hole portions 72 are formed in the encoder scale 71, the engagement portions 91 engaging with the engagement hole portions 72 are formed in the unit frame 81, the engagement hole portions 72 and the engagement portions 91 engage predetermined portions of the encoder scale 71 in the extension direction with the unit frame 81.

Figure 8A:
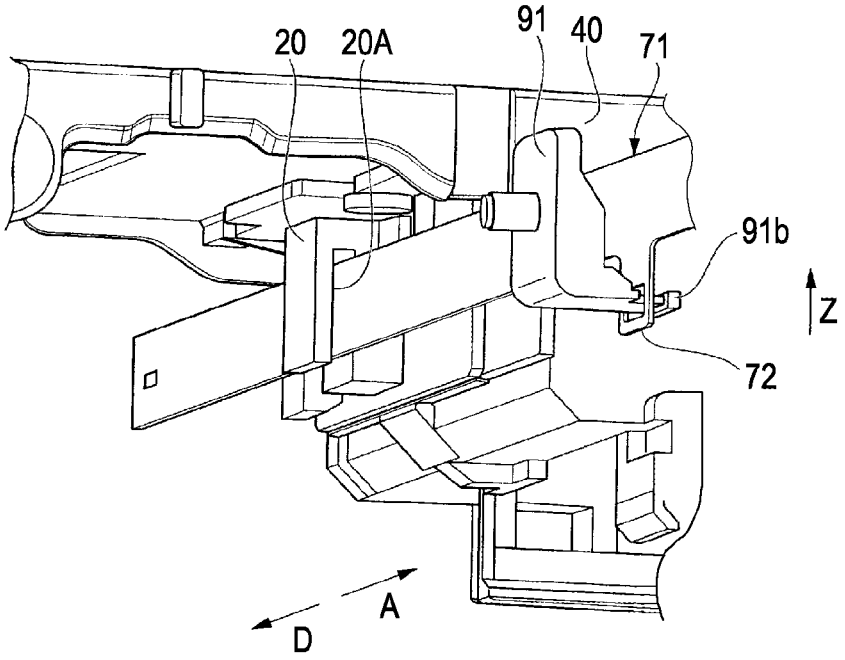
FIGS. 8A and 8B are sectional views illustrating the positional relation of the encoder scale, the detection unit, and the regulation unit at an ascending position.
Figure 8B:
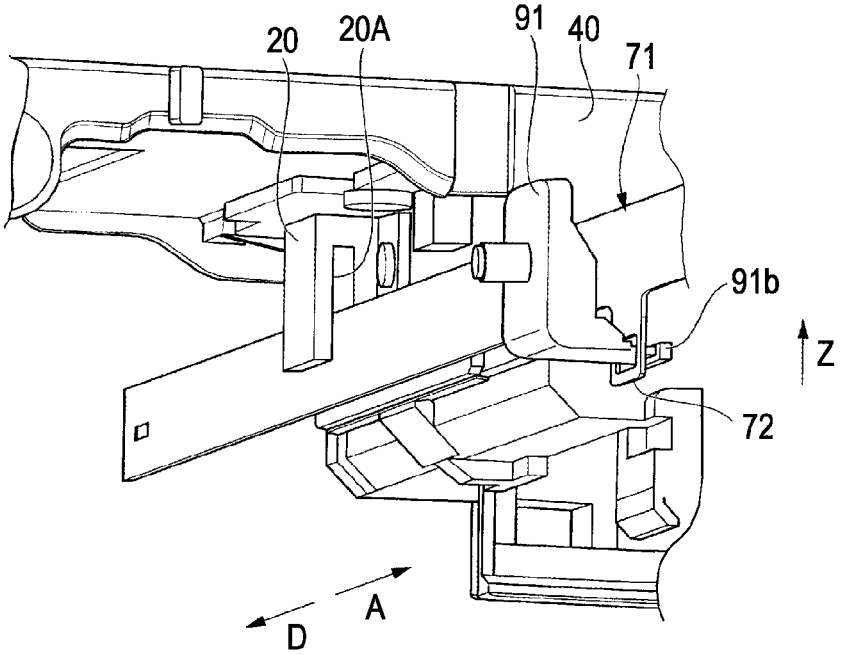

A positional relation of the detection sensor 20 (the carriage 40), the encoder scale 71, and the engagement portion 91 in a case of the minimum platen gap PG (reference position) and a case of the maximum platen gap PG (maximum ascending position) will be described below. FIG. 8A is a perspective view illustrating the case of the minimum platen gap PG. FIG. 8B is a perspective view illustrating the case of the maximum platen gap PG.

In the case of the minimum platen gap PG, that is, in a case where the detection sensor 20 is located at the reference position, as shown in FIG. 8A, the encoder scale 71 in the Z direction overlaps with the detection sensor 20 in the width direction of the encoder scale 71.

On the other hand, in the case of the maximum platen gap PG, that is, in a case where the detection sensor 20 is located at the maximum ascending position, as shown in FIG. 8B, the overlapping amount of the encoder scale 71 and the detection sensor 20 is small. Therefore, the encoder scale 71 may easily be deviated from the encoder slit 20A of the detection sensor 20. In this embodiment, however, the bending of the encoder scale 71 in the vertical direction or the bending of the encoder scale 71 in the transport direction A and the opposite direction D of the transport direction A is regulated by the engagement hole portions 72 and the engagement portions 91. Therefore, even when the carriage 40 is moved up due to the thickness of the printing medium P and the platen gap PG is varied, the encoder scale 71 is prevented from being deviated from the encoder slit 20A.

Accordingly, even when the encoder scale 71 rotates in the transport direction or the opposite direction to the transport direction and nearly comes out from the encoder slit 20A due to the touching of the user to the encoder scale 71, the engagement hole portions 72 come into contact with the engagement claws 91B of the engagement portions 91 and thus the further movement of the encoder scale 71 is regulated.

In the above-described embodiment, since the movement of the encoder scale 71 in the vertical direction and the movement of the encoder scale 71 in the transport direction and the opposite direction to the transport direction are regulated by the engagement hole portions 72 and the engagement portions 91, the encoder scale 71 can be prevented from being deviated from the encoder slit 20A. With the configuration according to this embodiment, the printing apparatus can effectively be miniaturized, since it is not necessary to ensure a new space in the lower portion of the encoder scale 71.

In the ink jet printer 1 according to this embodiment, the engagement hole portions 72 formed in the encoder scale 71 and the engagement portions 91 fixed to the unit frame 81 engage with each other in the unit frame 81 and the encoder scale 71 stretching in the unit frame 81. With such a configuration, the movement of the encoder scale 71 in the transport direction of the printing medium P and the opposite direction to the transport direction can be regulated. Therefore, the encoder scale 71 can be prevented from being deviated from the encoder slit 20A. Accordingly, the carriage unit 101 may be prevented from being broken down.

In this embodiment, each engagement claw 91B of the engagement portion 91 formed from the hook member engages in the hole of each engagement hole portion of the encoder slit. Moreover, since the front end 91*b* of the engagement claw 91B is bent toward the extension direction of the encoder scale 71, the movement of the encoder scale 71 in the transport direction of the printing medium P and the opposite direction to the transport direction is regulated. Moreover, the vertical bending of the encoder scale 71 in the extension direction can be prevented. Accordingly, the engagement of the engagement hole portions and the engagement portions can be maintained satisfactorily.

In this embodiment, since the encoder scale 71 stretches in the state where the encoder scale 71 is pulled in the extension direction by the elastic member 70, the bending of the encoder scale can be prevented and thus the engagement of the engagement hole portions 72 and the engagement portions 91 can be maintained satisfactorily. Moreover, the movement of the encoder scale 71 in the transport direction and the opposite direction to the transport direction can be regulated.

In this embodiment, two engagement portions 91 and two engagement hole portions 72 are provided. However, two or more engagement portions 91 and two or more engagement hole portions 72 may be provided. Alternatively, one engagement portion 91 and one engagement hole portion 72 may be provided in the middle of the encoder scale 71 in the extension direction. However, when the plurality of engagement portions 91 and engagement hole portions 72 are provided rather than providing one engagement portion 91 and one engagement hole portion 72, an advantage of preventing the bending of the encoder scale 71 can be obtained. In particular, it is preferable that since the middle of the belt-shaped encoder scale 71 in the extension is easily bent, the plurality of engagement portions 91 and engagement hole portions 72 are provided at a uniform interval in the extension direction across the portions including the middle of the belt-shaped encoder scale 71.

With such a configuration, since the engagement claws 91B of the engagement portions 91 scarcely come out from the holes 72*a* of the engagement hole portions 72, the engagement of the engagement hole portions 72 and the engagement portions 91 can be maintained satisfactorily. Accordingly, the encoder scale 71 can be reliably prevented from being deviated from the encoder slit 20A.

In this embodiment, the engagement hole portions 72 and the engagement portions 91 engage with each other in the non-contact state. However, parts of the engagement hole portions 72 and the engagement portions 91 may come into contact with each other.

The preferred embodiment of the invention has hitherto been described with reference to the accompanying drawings, but the invention is not limited to the embodiment. It is apparent to those skilled in the art that the embodiment is modified and altered in various forms within the technical spirit of the invention described in the claims, and the modifications and the alterations pertain to the technical spirit of the invention.

What is claimed is:

1. A printing apparatus comprising:

a frame supporting a transport roller transporting the printing medium, a carriage mounting print head, executing scanning in a direction perpendicular to a transport direction of a printing medium;

an encoder scale having a predetermined pattern and extending in the direction perpendicular to the transport direction, the encoder scale having a first end mounting portion to mount to one side portion of the frame and a second end mounting portion to mount to an opposing side to the one side portion of the frame;

a detection sensor detecting the pattern of the encoder scale and including a slit into which the encoder scale is inserted; and wherein the encoder scale has a protrusion that protrudes from the predetermined pattern between the first end mounting portion and the second end mounting portion, the protrusion protrudes in a protruding direction intersecting with a direction connecting the first end mounting portion and the second end mounting portion, and the protruding direction is intersecting to the transport direction, wherein an engagement hole portion is disposed in the protrusion and an engagement portion is disposed in the frame and engages with the engagement hole portion, the engagement hole portion extending in the direction connecting the first end mounting portion and the second end mounting portion, and wherein the engagement portion passes through the engagement hole portion, extends in the direction connecting the first end mounting portion and the second end mounting portion, and faces to the protrusion.

2. The printing apparatus according to claim 1, wherein one end of the encoder scale is directly fixed to one wall of the frame, which faces the one end of the encoder scale in a direction perpendicular to the transport direction, and the other end of the encoder scale is fixed to the other wall through an elastic member, and wherein the encoder scale stretches by an urging force of the elastic member.

3. The printing apparatus according to claim 1, wherein a front end of the engagement portion extends in the extension direction of the encoder scale and is formed as a hook member formed so as to be bent toward the elastic member.

4. The printing apparatus according to claim 1, wherein a plurality of the protrusions are formed in the extension direction of the encoder scale.

* * * * *